US005368254A

United States Patent [19]

Wickholm

[11] Patent Number: 5,368,254

[45] Date of Patent: Nov. 29, 1994

[54] OPTICAL IMAGING SYSTEM INCLUDING GENERALLY CONICAL, TRANSPARENT PROTECTIVE DOME AND OPTICALLY REFRACTIVE FIXED CORRECTOR FOR REVERSING CONICAL DEFORMATION CREATED BY VIEWING THROUGH THE DOME

[75] Inventor: David R. Wickholm, Fort Wayne, Ind.

[73] Assignee: Hughes Aircraft Company, Los Angeles, Calif.

[21] Appl. No.: 32,040

[22] Filed: Mar. 16, 1993

[51] Int. Cl.[5] ..... F41G 7/26

[52] U.S. Cl. ..... 244/3.16

[58] Field of Search ..... 244/3.16; 250/201.9

[56] References Cited

U.S. PATENT DOCUMENTS

| | | | |
|---|---|---|---|
| 4,291,848 | 9/1981 | Clark | 244/3.16 |
| 4,384,759 | 5/1983 | Ferrante | 359/16 |
| 5,220,159 | 6/1993 | Friedenthal | 250/201.9 |

*Primary Examiner*—Ian J. Lobo

*Attorney, Agent, or Firm*—Randall M. Heald; Charles D. Brown; Wanda K. Denson-Low

[57] ABSTRACT

A camera (40) is mounted on a gimbal (44) inside a missile (30) and views forwardly through a transparent, generally conical front dome or ogive (70). An optically refractive corrector (72) is mounted in front of the camera lens (42) for integral movement therewith. The corrector (72) has a least one conical surface segment (74*a*,74*b*) which is dimensioned to reverse optical conical deformation created by the dome (70). The conical deformation includes little or no refractive power in a plane defined by the axis (38) of the dome (70) and the look axis (46) of the camera (40) and gimbal (44), and progressively varying one-dimensional refraction perpendicular to this plane. Variables including the apex angles ($\alpha$1,$\alpha$2) of cones (76,78) which define the surfaces (74*a*,74*b*), the angle ($\alpha$3) between the axes (76*b*,78*b*) of the cones (76,78), the distances (D1,D2) between the apices (76*a*,78*a*) of the cones (76,78) and the center (74*c*) of the corrector (72), the tilt angle ($\alpha$5) and the index of refraction of the corrector (72) provide sufficient degrees of freedom to enable a best fit solution which substantially reverses the conical deformation created by the dome (70).

26 Claims, 5 Drawing Sheets

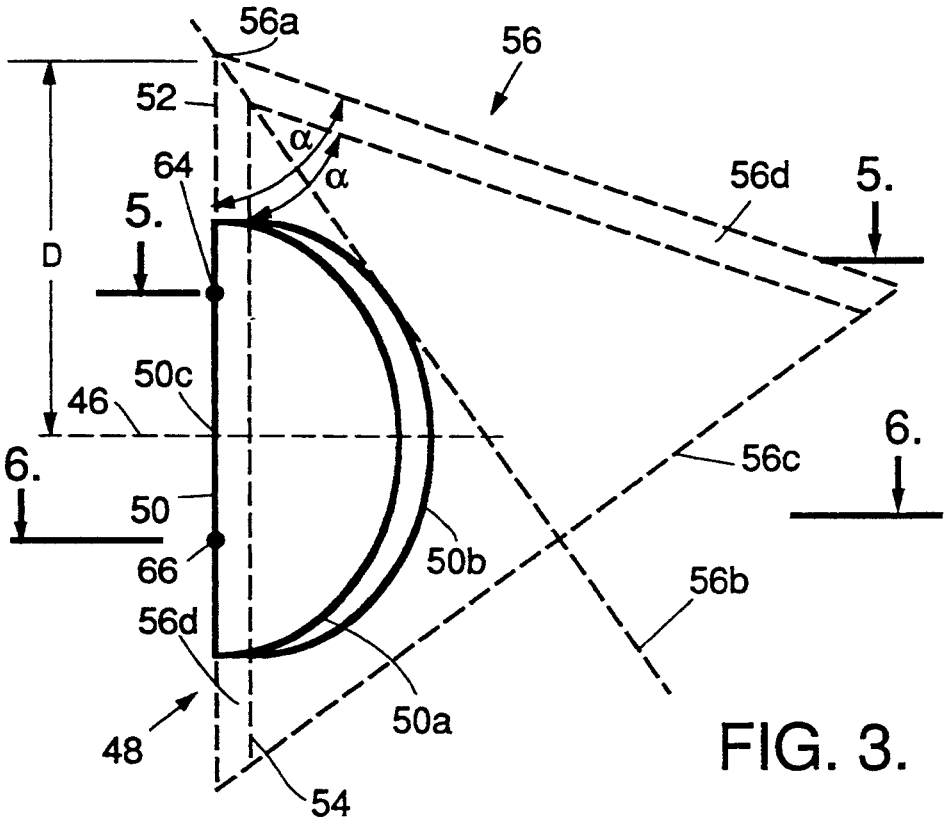
FIG. 3.
FIG. 5.
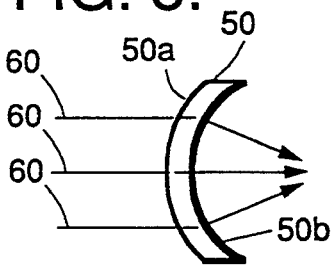
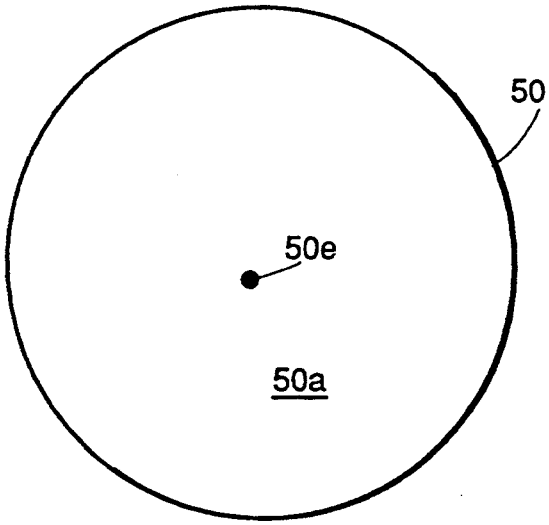
FIG. 4.
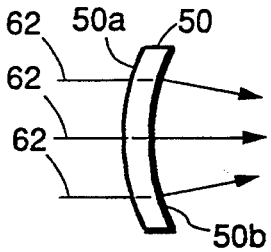
FIG. 6.

OPTICAL IMAGING SYSTEM INCLUDING GENERALLY CONICAL, TRANSPARENT PROTECTIVE DOME AND OPTICALLY REFRACTIVE FIXED CORRECTOR FOR REVERSING CONICAL DEFORMATION CREATED BY VIEWING THROUGH THE DOME

BACKGROUND OF THE INVENTION

1. Field of the Invention

The present invention generally relates to the art of optical imaging systems, and more specifically to the correction of conical deformation created by a camera viewing through a transparent, generally conical dome or ogive.

2. Description of the Related Art

A rocket or missile is preferably provided with a streamlined nose cone or front dome to minimize aerodynamic drag and maximize the efficiency of its propulsion system. The dome is pointed at its front end, and is axi-symmetric in that its cross section in any plane perpendicular to its longitudinal axis is circular. The dome can be perfectly conical, or have a generally conical ogive shape with a gradually curved cross section in a plane passing through its longitudinal axis.

Cameras are carried by missiles for guidance, tracking and information gathering purposes. The camera must face generally forward for tracking a ground or airborne target. It is highly desirable to make the dome transparent and mount the camera on a gimbal inside the missile so that it can view forwardly through the dome at a variable angle. However, the dome creates optical aberrations which make objects viewed therethrough appear offset from their true positions.

A dome having an ogive shape such as defined by the well known Von Karman equations is desirable over a perfectly conical dome since it produces less drag. However, a curved dome such as a Von Karman ogive introduces an aberration known as "boresight error" such that a ray passing through the dome surface exits at an angle which is non-parallel to its entrance angle.

Boresight error can be eliminated by making the inner surface of the dome non-parallel to the outer surface as disclosed in copending U.S. Pat. No. 5,220,159 filed Sep. 23, 1991, entitled "REFRACTION CORRECTION FOR AXISYMMETRIC VIEWING WINDOW" by K. Friedenthal.

A second type of aberration created by viewing through a conical or generally conical ogive dome is known as "conical deformation" and is generally astigmatic. For a perfectly conical dome, there is zero refractive power in a plane defined by the longitudinal axis of the dome and the gimbal look axis, and one-dimensional diverging power perpendicular to this plane. The power is theoretically infinite at the tip of the dome, and decreases progressively with distance from the tip. For a Von Karman or other ogive having a curved shape, there is also a relatively small amount of diverging power in the plane of the dome and gimbal look axes.

The one-dimensional refraction created by a conical dome is comparable to that created by a cylindrical lens. For this reason, attempts have been made to eliminate conical deformation using cylindrical lenses. Although a portion of the deformation can be reversed (canceled or corrected) by a cylindrical lens, the refracting power of a dome is not constant with position as with a cylindrical lens, but increases toward the tip of the dome.

For this reason, an unacceptable amount of residual conical deformation exists at all but a single viewing position on the dome, even if a best compromise cylinder power has been determined based on the geometry of the design.

SUMMARY OF THE INVENTION

In accordance with the present invention, a camera is mounted on a gimbal inside a missile and views forwardly through a transparent, generally conical front dome or ogive. An optically refractive corrector is mounted in front of the camera lens for integral movement therewith.

The corrector has a least one conical surface segment which is dimensioned to reverse optical conical deformation created by the camera viewing through the dome. The conical deformation of the dome includes little or no refractive power in a plane defined by the longitudinal axis of the dome and the gimbal look axis, and progressively varying one-dimensional diverging power perpendicular to this plane.

Conical deformation created by a perfectly conical dome can reversed (canceled or corrected) by a corrector having a single convex surface and a flat surface, or opposite convex and concave surfaces. For an ogive with a curved Von Karman or other shape, the corrector can have convex and concave conical surfaces which are offset from each other to further correct for refractive power of the dome in the plane defined by the longitudinal axis of the dome and the gimbal look axis as well as in the plane perpendicular thereto.

Variables including the apex angles of the cones, the angle between the axes of the cones, the distances between the apices of the cones and the center of the corrector, the tilt angle and index of refraction of the corrector provide sufficient degrees of freedom to enable a best fit solution which substantially cancels the conical deformation created by the dome.

These and other features and advantages of the present invention will be apparent to those skilled in the art from the following detailed description, taken together with the accompanying drawings, in which like reference numerals refer to like parts.

DESCRIPTION OF THE DRAWINGS

FIG. 3 is a side elevation illustrating the corrector of FIG. 2;

FIG. 4 is front elevation of the corrector;

FIG. 5 is a section taken on a line V—V of FIG. 3;

FIG. 6 is a section taken on a line VI—VI of FIG. 3;

DETAILED DESCRIPTION OF THE INVENTION

Figure 1:
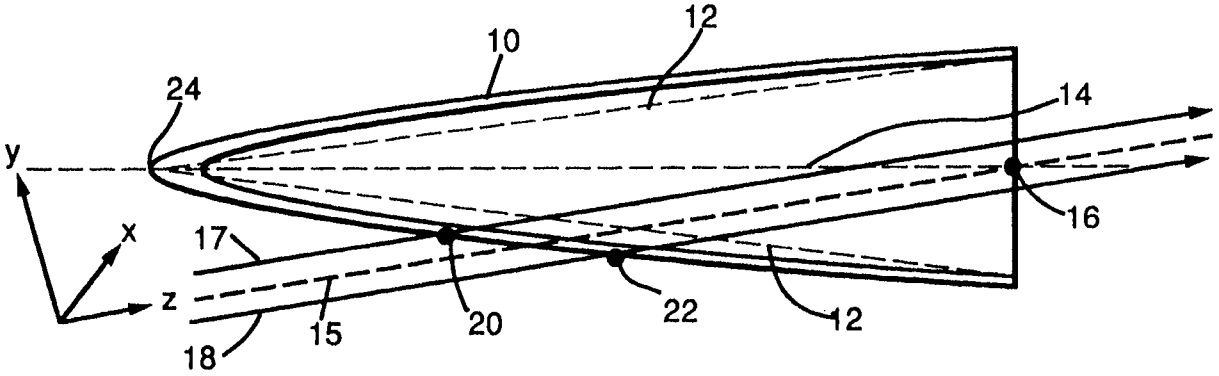
FIG. 1 is a diagram for describing the conical optical deformation created by viewing through a generally conical dome or ogive.

FIG. 1 illustrates a transparent, generally conical front dome or ogive 10 for a rocket, missile or the like. For the purposes of the invention, the term "generally conical" encompasses shapes including a perfect cone 12 as indicated in broken line, and shapes such as the illustrated dome 10 which differ somewhat from the cone 12 but have pointed front ends and are axi-symmetric about a central longitudinal axis 14.

The outer surface of the dome 10 is preferably defined by the well known Von Karman equations, providing a much more streamlined shape and thereby lower aerodynamic drag than the cone 12. The inner surface of the dome 10 is preferably non-parallel to the outer surface thereof as disclosed in the above referenced copending application to Friedenthal to correct for "boresight error", such that a light ray passing through the dome 10 exits parallel to its entrance path.

It will be assumed that a scene forward and below the dome 10 is viewed along an axis 15 which intersects the axis 14 at a center 16 of the base of the dome 10. A three dimensional rectangular coordinate system includes a Z axis which coincides with the axis 15, and X and Y axes which extend perpendicular to the Z axis. In the illustrated case in which the Y and Z axes lie in the plane of the drawing, the X axis is perpendicular to the plane of the drawing.

The dome 10 creates conical deformation of light passing therethrough, and distortion of an image of a scene viewed through the dome 10. It will be assumed that two sets of parallel light rays 17 and 18 pass through the dome 10 from left to right parallel to the axis 15, with the rays 17 being closer to the axis 14 than the rays 18. The rays 17 are laterally spaced from each other perpendicular to the plane of the drawing. The rays 18 are similar to the rays 17. The rays 17 and 18 are refracted by the dome 10 so as to diverge in planes which are parallel to the plane defined by the X and Z axes. In the illustrated case in which the Y and Z axes lie in the plane of the drawing, the divergence of the rays 17 and 18 occurs in planes which lie above and below the axis 15 respectively and extend perpendicular to the plane of the drawing.

However, the optical power of the dome 10 in the X-Y plane at a point 20 at which the rays 17 pass therethrough is greater than the optical power thereof at a point 22 at which the rays 18 pass through the dome 10. For this reason, the rays 17 are refracted more than the rays 18. The refractive power at a tip 24 of the dome 10 can be theoretically infinite, and decreases with distance from the tip 24.

The diverging refraction created by the dome 10 or 12 is known as "conical deformation" and is generally astigmatic in that in its pure form there is no refraction in one plane (the plane of the drawing in which the Y and Z axes lie) and one-dimensional refraction in an orthogonal plane (perpendicular to the plane of the drawing and coincident with or parallel to the X/Z plane). Although comparable to the one-dimensional refraction created by a cylindrical lens, conical deformation differs from cylinder refraction in that the lens power or amount of refraction varies with position along the surface of the dome, rather than being constant as is the case of a cylindrical lens.

For the case of the perfect cone 12, all of the divergence occurs in or parallel to the X/Z plane, and there is no divergence in the Y/Z plane. However, for the dome 10 which has a curved cross section in the Y/Z plane, there will be a relatively small amount of divergence in the Y/Z plane which depends on the curvature of the dome 10.

Figure 2:
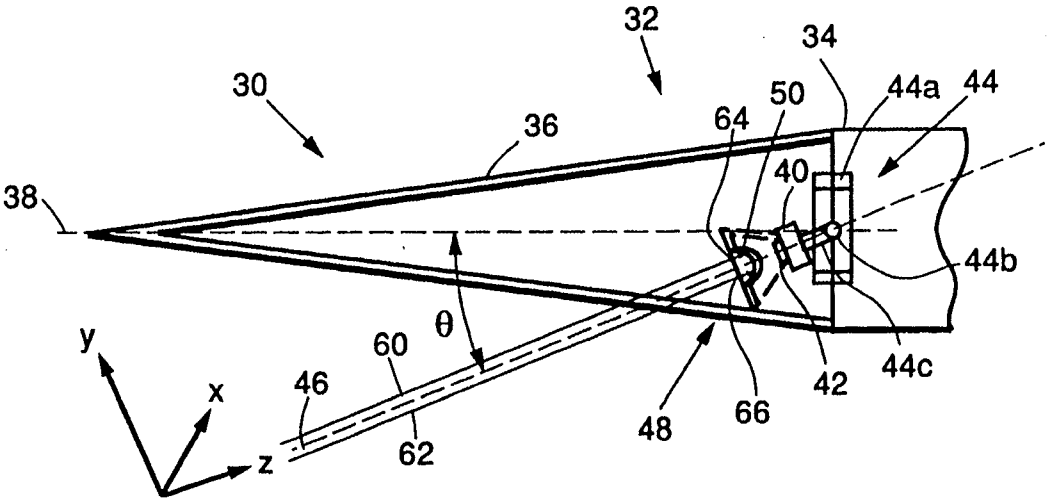
FIG. 2 is similar to FIG. 1, but illustrates a first corrector embodying the invention for reversing the conical deformation.

A missile 30 including an optical imaging system 32 embodying the present invention is illustrated in FIG. 2 The missile 30 includes a body 34 having a transparent dome 36 mounted on its front end. The dome 36 is axi-symmetric about a central longitudinal axis 38 and has a perfectly conical shape as illustrated at 12 in FIG. 1.

A camera 40 having an imaging lens 42 is mounted on a gimbal 44 inside the body 34 so as to view forwardly through the dome 36. The gimbal 44 is driven by a servo system (not shown) so as to track a target on the ground or in the air, and may have any desired number of degrees of freedom of movement. In the preferred embodiment, the gimbal 44 includes a cylindrical cage **44*a* which is rotatable about the axis 38 and supports a shaft 44*b* which spans a diameter of the cage 44*a* and rotates integrally therewith. The camera 40 is mounted on an arm 44*c* which is rotatably supported by the shaft 44*b***.

With the gimbal 44 oriented in the position illustrated in FIG. 2, the shaft **44*b* extends parallel to the X axis (perpendicular to the plane of the drawing), and the camera 40 is rotatable or tiltable about the X axis. As shown, the camera 40 is tilted downwardly relative to the axis 38 by an angle $\theta$. The gimbal 44 enables the camera 40 to cover the entire field of view forward of the dome 36 with 360° of freedom of rotation about the longitudinal axis 38, and up to 90° of freedom of rotation ($0 \leqq \theta \leqq 90°$) about the axis of the shaft 44*b*. At any position of the gimbal 44, a look axis 46 of the gimbal 44 and camera lens 42 is coplanar with the axis 38 so that the conical deformation created by the dome 36** varies only in one dimension (with the angle $\theta$).

In accordance with the present invention, a corrector 48 is mounted in front of the camera lens 42 for integral movement therewith. As better seen in FIGS. 3 to 6, the corrector 48 includes a body 50 formed of a transparent, optically refractive material. As illustrated in FIG. 4, the body 50 is preferably circular as viewed along the axis 46, although the invention is not so limited. The body 50 has a convex conical front surface **50*a* which faces the dome 36 and is defined by a cone 52, and a concave conical rear surface 50*b* which faces the camera 40 and is defined by a cone 54**.

The cone 54 is smaller than and parallel to the cone 52 such that if the space between the cones 52 and 54 were filled with solid material, the cones 52 and 54 in combination would define a hollow cone 56 having a generally upwardly pointing (inclined above the axis 46) apex **56*a*, a central axis 56*b*, a base 56*c* and a wall 56*d* of uniform thickness. The body 50 constitutes a segment or portion of the cone 56, with the surfaces 50*a* and 50*b* being segments of the conical surfaces of the cones 52 and 54** respectively.

The body 50 has a center **50*c* which lies on the axis 46, and is oriented such that the axis 46 is normal to the convex surface 50*a* and also to the concave surface 50*b* at the center 50*c*. The center 50*c* is displaced from the apex 56*a* of the cone 56 by a decenter distance D. The cones 52, and 54 and 56 have a common apex angle $\alpha$. The corrector 48 has a converging refracting power which reverses (cancels or corrects) the divergence created by the dome 36**.

Referring again to FIG. 2, sets of light rays 60 and 62 which are similar to the rays 17 and 18 described with reference to FIG. 1 pass through the dome 36 parallel to, and above and below the axis 46 respectively. The rays 60 and 62 pass through the corrector 48 and are focussed by the camera lens 42 to form an optical image in the camera 40. The rays 60 are closer to the axis 38 of the dome 36 than are the rays 62, and are therefore subjected to a greater amount of conical deformation and thereby diverging refraction than the rays 62.

However, the corrector 48 is dimensioned and oriented in such a manner as to reverse or correct the conical deformation created by the dome 36 such that the image of a scene viewed by the camera 40 through the dome 36 is of high resolution. More specifically, the optical power of the body 50 in the X-Y plane at a point 64 where the rays 60 pass through the body 50 is greater than the optical power of the body 50 at a point 66 where the rays 62 pass through the body 50. FIGS. 5 and 6 are cross sections through the points 64 and 66 respectively which illustrate the difference in optical power at the points 64 and 66.

The ray 60 is converged by the body 50 parallel to the X/Z plane by an amount which is substantially equal to the divergence created by the dome 36. The ray 62 is converged by the body 50 parallel to the X/Z plane by an amount which is substantially equal to the divergence created by the dome 36, with the amount of divergence and convergence being less than that of the ray 60. The thickness and index of refraction of the body 50, the apex angle $\alpha$ and decenter distance D are selected in accordance with the geometry of the dome 36 so as to create equal and opposite conical deformation which reverses that created by the dome 36 and produce a high resolution view through the dome 36.

Figure 7:
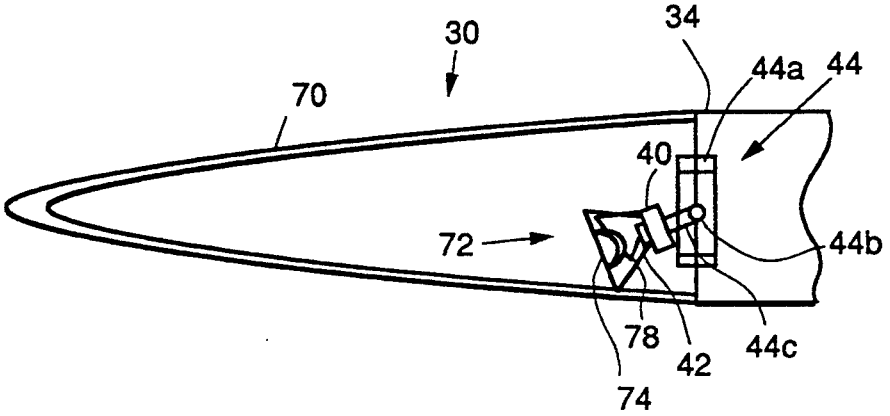
FIG. 7 is similar to FIG. 2, but illustrates a second corrector embodying the invention.

The dome 36 illustrated in FIG. 2 is perfectly conical and creates optical aberration only in or parallel to the X/Z plane. The aberration is constituted by pure conical deformation, and can be reversed by the corrector body 50 which has a purely conical shape with uniform wall thickness. FIG. 7 illustrates a dome 70 in the shape of a curved ogive such as defined by the Von Karman equations and designated as 10 in FIG. 1. As discussed above, the dome 70 additionally creates divergence in the Y/Z plane which is smaller than the divergence in or parallel to the X/Z plane.

Figure 8:
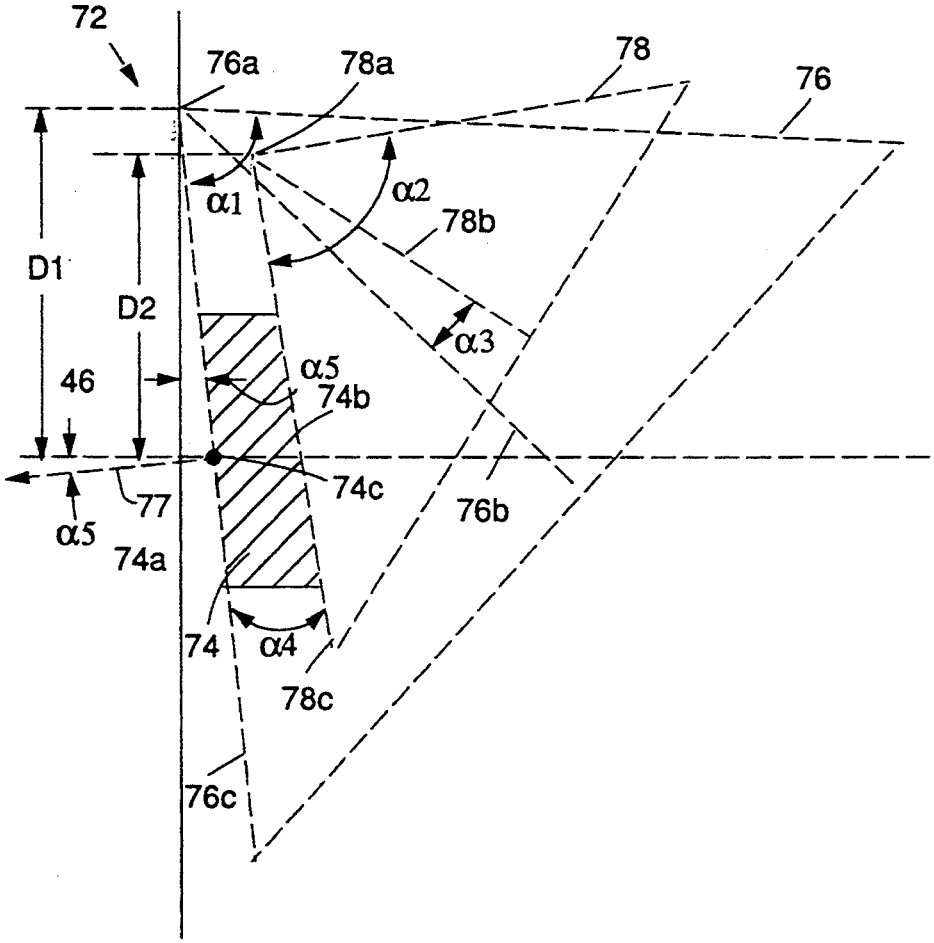
FIG. 8 is a diagrammatic sectional view illustrating the design variables of the corrector of FIG. 7.

Although the resolution through the dome 70 can be greatly improved using the corrector 48, it can be improved yet further and/or the gimbal look angle can be increased by a corrector 72 which is illustrated in vertical cross section in FIG. 8. The corrector 72 has a body 74 which is defined by two offset cones 76 and 78 and highlighted by cross hatching in the drawing. The corrector 72 can thereby be referred to as a "double offset cone corrector". The cone 76 defines a convex conical front surface 74*a* which faces the dome 70, whereas the cone 78 defines a concave rear surface 74*b* which faces the camera 40. The thickness of the body 74 increases from the upper to the lower portion thereof.

The cone 76 has an apex 76*a*, a central axis 76*b*, and a wall 76*c* which defines the surface 74*a* of the corrector body 74. The cone 78 has an apex 78*a*, a central axis 78*b*, and a wall 78*c* which defines the surface 74*b* of the body 74. The cone 76 has an apex angle $\alpha 1$ which is illustrated as being larger than an apex angle $\alpha 2$ of the cone 78. The axes 76*b* and 78*b* lie in the plane of the drawing, and extend at an angle $\alpha 3$ relative to each other. The apices 76*a* and 78*a* point generally upwardly (inclined above the axis 46) at angles which differ from each other by less than 90°.

The body 74 has a center 74*c* through which the axis 46 passes. The apex 76*a* of the cone 76 is vertically spaced from the center 74*c* by a decenter distance D1 which is illustrated as being greater than a decenter distance D2 between the axis 78*a* of the cone 78 and the center 74*c*. A wedge angle $\alpha 4$ is defined between the surfaces 74*a* and 74*b* of the body 74. A line 77 which is normal to the front surface 74*a* at the center 74*c* is tilted downwardly from the axis 46 by an angle $\alpha 5$. The front surface 74*a* is consequently tilted forward from the vertical by the angle $\alpha 5$.

Due to extensive interaction between variables, the dimensions of the correctors 48 and 72 are preferably determined by an optical analysis program which is commercially available for use with a general purpose computer. A representative program is marketed as "CodeV" by Optical Research Associates of Pasadena, Calif. The procedure includes inputting the geometry of the dome 36 or 70, and individually varying the dimensions of the corrector 48 or 72 until a best fit compromise solution is obtained. The values to be optimized typically include standardized parameters such as root mean square (RMS) spot size and image quality expressed as amount of wavefront error.

The variables for the corrector 48 include the apex angle $\alpha$, decenter distance D and the index of refraction and thickness of the body 50. The variables for the corrector 72 include the apex angles $\alpha 1$ and $\alpha 2$ and the angle $\alpha 3$ between the axes 76*b* and 78*b* which in combination determine the wedge angle $\alpha 4$, the tilt angle $\alpha 5$, the decenter distances D1 and D2 and the index of refraction of the body 74. Generally, the index of refraction is made as large as practical to minimize the thickness of the corrector 48 or 72.

The conical deformation created by the dome 36 or 70 varies with the pitch or tilt angle $\theta$ of the camera 40 as described with reference to FIG. 2. More specifically, the deformation decreases as the angle $\theta$ increases. A fixed corrector will provide optimal correction of conical deformation only at a particular value of $\theta$. The optical power of the dome 36 or 70 is so large at small values of $\theta$ that imaging at these angles is impractical. Therefore, the angle $\theta$, within a predetermined usable range, is preferably included as a variable in computing the best fit compromise solution for the corrector geometry.

The large number of individually variable dimensions enable a best fit compromise solution which will reverse the conical deformation created by the dome 36 or 70 to enable substantially undistorted imaging by the camera 40. In the case of the dome 70, the conically distorted wavefront is converted to a nominally spherical wavefront by the corrector 72 with negligible change in focus as a function of $\theta$. Thus, the camera 40 can be of the fixed focus type.

However, if refocussing is necessary, it can be accomplished automatically if the camera 40 is provided with an autofocus mechanism. If not, the amount of refocus is a direct function of the angle $\theta$, and can be predetermined and programmed into a focus servo drive (not shown) for the camera 40.

Figure 9:
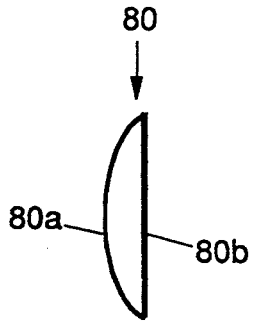
FIGS. 9 and 10 are sectional views illustrating third and fourth correctors embodying the invention.
Figure 10:
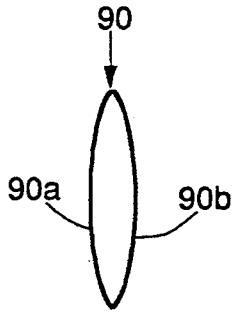

Whereas the correctors 48 and 72 have two opposite convex and concave surfaces, it is within the scope of the invention to configure a corrector as having any conical shape with converging refractive power. FIG. 9 illustrates, in horizontal cross section, a corrector 80 having a convex conical front surface 80*a* and a flat or planar rear surface 80*b*, whereas FIG. 10 illustrates a corrector 90 having convex conical front and rear surfaces 90*a* and 90*b* respectively.

A corrector embodying the present invention is preferably formed of a material such as germanium (Ge) or silicon (Si) which has a relatively high index of refraction and can be machined in a lathe using a diamond cutting tool. However, other materials such as gallium arsenide (GaAs), zinc sulfide (ZnS) or zinc selenide (ZnSe) which have high indices of refraction can be used for practicing the invention.

Figure 11:
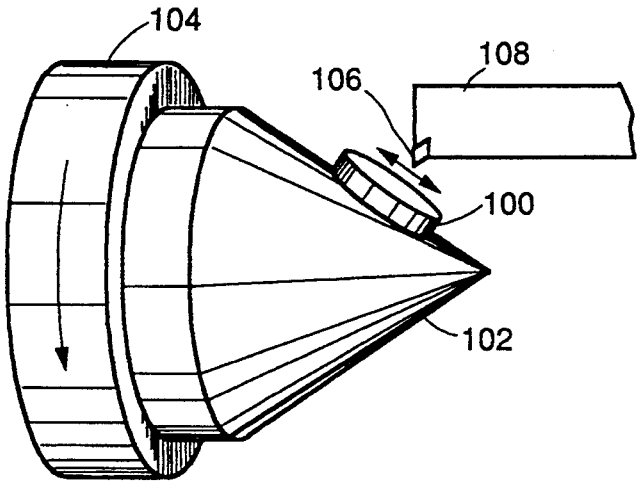
FIG. 11 is a perspective view illustrating a method of forming a convex surface of the present corrector.
Figure 12:
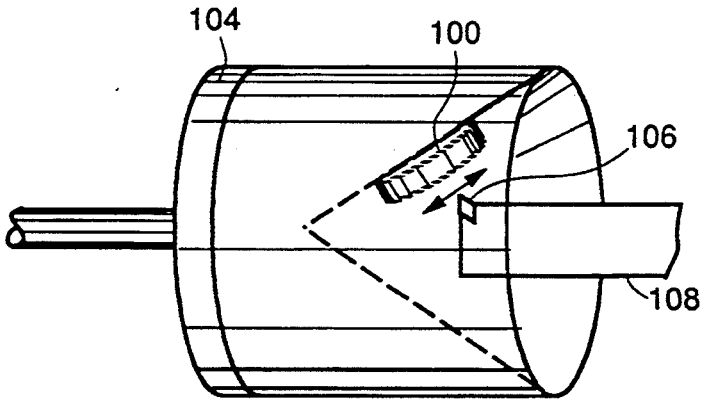
FIG. 12 is similar to FIG. 11 but illustrates a method of forming a concave surface of the corrector.

FIGS. 11 and 12 illustrate an exemplary method of fabricating the corrector 72 by diamond turning. In FIG. 11, a blank 100 made of silicon or the like is fixed to a jig 102 which is in turn mounted on a lathe chuck 104. The jig 102 has an outer surface in the shape of a cone with the same apex angle as the cone 76 which defines the convex front surface 74*a* of the corrector body 74. The blank 100 is rotated integrally with the chuck 104 and jig 102, and a diamond cutting tool 106 is moved via a feed arm 108 to cut or machine the exposed surface of the blank 100 into the shape of the cone 76.

Then, as illustrated in FIG. 12, a jig 110 having an inner surface in the shape of a cone with the same apex angle as the cone 78 which defines the concave rear surface 74*b* of the corrector body 74 is mounted on the chuck 104, and the blank 100 is fixed to the jig 110 with the unmachined surface exposed. The tool 106 is then moved by the feed arm 108 to cut the exposed surface of the blank 100 into the shape of the cone 78.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

I claim:

1. A corrector for correcting optical conical deformation created by a transparent, generally conical dome, comprising a single fixed, transparent, passive optically refractive body disposed within the dome having at least one substantially conical surface for creating reverse conical deformation which is substantially the inverse of said conical deformation created by the dome.

2. A corrector as in claim 1, in which said at least one substantially conical surface comprises a first conical surface segment formed on one side of the body and a second conical surface segment formed on an opposite side of the body.

3. A corrector as in claim 2, in which said first and second conical surface segments have axes of revolution which lie in a plane.

4. A corrector as in claim 2, in which said first and second conical surface segments have axes of revolution which are non-parallel to each other.

5. A corrector as in claim 2, in which said first and second conical surface segments have apices which point in directions which differ from each other by less than a right angle.

6. A corrector as in claim 2, in which said first and second conical surface segments have different apex angles.

7. A corrector as in claim 2, in which said first and second conical surface segments are decentered by different distances.

8. A corrector as in claim 2, in which said first conical surface segment is convex and said second conical surface segment is concave.

9. A corrector as in claim 2, in which said first and second conical surface segments are convex.

10. A corrector as in claim 1, in which:

said at least one substantially conical surface comprises a convex conical surface segment formed on one side of the body; and the body has a flat surface on an opposite side thereof.

11. A corrector as in claim 1, in which:

said at least one conical surface comprises a convex conical surface segment; and said at least one substantially conical surface is shaped to create said reverse conical deformation upon viewing through the body substantially normal to said convex conical surface segment.

12. A corrector as in claim 1, in which:

said at least one conical surface comprises a concave surface segment; and said at least one substantially conical surface is shaped to create said reverse conical deformation upon viewing through the body substantially normal to said concave conical surface segment.

13. An optical imaging system, comprising:

a transparent, generally conical dome which creates optical conical deformation when viewed therethrough;

a camera for viewing through the dome; and a corrector including a single fixed, transparent, passive optically refractive body which is disposed between the camera and the dome and has at least one substantially conical surface for creating reverse conical deformation which is substantially the inverse of said conical deformation created by the camera viewing through the dome.

14. A system as in claim 13, in which:

the camera includes an imaging lens; and the corrector is mounted in front of and integrally movable with the imaging lens relative to the dome.

15. A system as in claim 13, in which said at least one substantially conical surface comprises a first conical surface segment formed on one side of the body and a second conical surface segment formed on an opposite side of the body.

16. A system as in claim 15, in which said first and second conical surface segments have axes of revolution which lie in a plane.

17. A system as in claim 15, in which said first and second conical surface segments have axes of revolution which are non-parallel to each other.

18. A system as in claim 15, in which said first and second conical surface segments have apices which point in directions which differ from each other by less than a right angle.

19. A system as in claim 15, in which said first and second conical surface segments have different apex angles,

20. A system as in claim 15, in which said first and second conical surface segments are decentered by different distances.

21. A system as in claim 15, in which said first conical surface segment is convex and said second conical surface segment is concave.

22. A system as in claim 15, in which said first and second conical surface segments are convex.

23. A system as in claim 13, in which:

said at least one substantially conical surface comprises a convex conical surface segment formed on one side of the body; and the body has a flat surface on an opposite side thereof.

24. A system as in claim 13, in which:

said at least one conical surface comprises a convex conical surface segment; and said at least one substantially conical surface is shaped to create said reverse conical deformation upon viewing through the body substantially normal to said convex conical surface segment.

25. A system as in claim 13, in which:

said at least one conical surface comprises a concave conical surface segment; and said at least one substantially conical surface is shaped to create said reverse conical deformation upon viewing through the body substantially normal to said concave conical surface segment.

26. A missile, comprising:

a transparent, generally conical front dome which creates optical conical deformation when viewed therethrough;

a camera mounted inside the dome for viewing therethrough; and a corrector including a single fixed, transparent, passive optically refractive body which is disposed between the camera and the dome and has at least one substantially conical surface for creating reverse conical deformation which is substantially the inverse of said conical deformation created by the camera viewing through the dome.

* * * * *